United States Patent [19]

Brand et al.

[11] Patent Number: 4,962,737

[45] Date of Patent: Oct. 16, 1990

[54] DEVICE FOR CONTROLLING AT LEAST ONE THROTTLE CROSS-SECTION AT A CONTROL OPENING

[75] Inventors: Günter Brand, Stuttgart; Hartmut Brammer, Vaihingen/Enz; Richard Gerber, Stuttgart; Otto Glöckler, Renningen; Gerold Grimm, Leonberg; Hans-Ulrich Gruber, Gerlingen; Dieter Günther, Murr; Jörg Issler, Stuttgart; Harald Kalippke, Benningen; Wolfgang Lölhöffel, Ditzingen; Helmut Maurer, Vaihingen; Ulrich Mayer, Waiblingen; Günther Plapp, Filderstadt; Erhard Renninger, Markgröningen; Claus Ruppmann, Stuttgart; Harald Sailer, Markgröningen; Peter Werner, Wiernsheim, all of Fed. Rep. of Germany

[73] Assignee: Robert Bosch GmbH, Stuttgart, Fed. Rep. of Germany

[21] Appl. No.: 432,735

[22] PCT Filed: Apr. 20, 1988

[86] PCT No.: PCT/DE88/00238

§ 371 Date: Nov. 1, 1989

§ 102(e) Date: Nov. 1, 1989

[87] PCT Pub. No.: WO88/09435

PCT Pub. Date: Dec. 1, 1988

[30] Foreign Application Priority Data

May 19, 1987 [DE] Fed. Rep. of Germany ..... 3716661

[51] Int. Cl.[5] ..... F02D 9/00

[52] U.S. Cl. ..... 123/339; 123/585

[58] Field of Search ..... 123/339, 585, 340, 198 D; 135/129.15, 129.17; 251/129.17

[56] References Cited

U.S. PATENT DOCUMENTS

| | | | |
|---|---|---|---|
| 4,756,286 | 7/1988 | Wietschorke et al. | 123/339 |
| 4,781,161 | 11/1988 | Sausner et al. | 123/339 |
| 4,873,954 | 10/1989 | Codling | 123/339 |
| 4,873,955 | 10/1989 | McAuliffe, Jr. | 123/585 |

*Primary Examiner*—Raymond A. Nelli

*Attorney, Agent, or Firm*—Michael J. Striker

[57] ABSTRACT

A device for controlling a throttle cross-section of at least one control orifice in a bypass line extending around a throttle valve of an air intake pipe of an internal combustion engine, for regulating an idle speed of the internal combustion engine, and comprising a throttle member, a spring element for biasing the throttle member to an initial position thereof, and a positioning motor for moving the throttle member from its initial position against a bias force of the spring element, upon failure of the spring element and when the positioning motor is actuated, to establish a safety cross-section in the bypass line, a quantity of operating medium flowing through the safety cross-section being less than a quantity of operating medium flowing through a complete cross-section of the control orifice whereby idle operation of the internal combustion engine is insured.

5 Claims, 5 Drawing Sheets

FIG. 5a
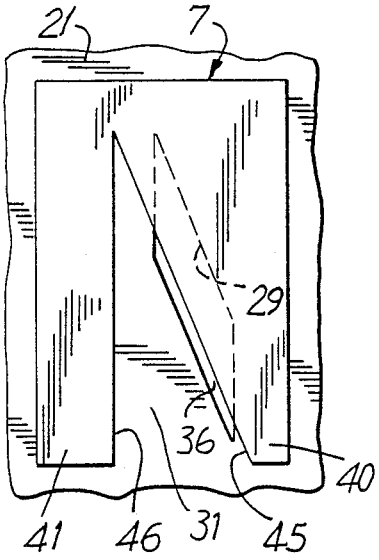
FIG. 5b
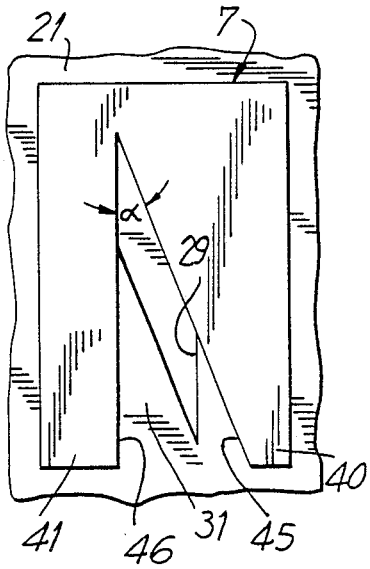
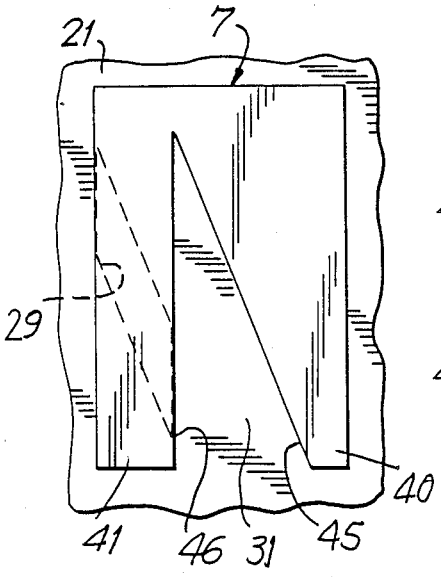
FIG. 5c
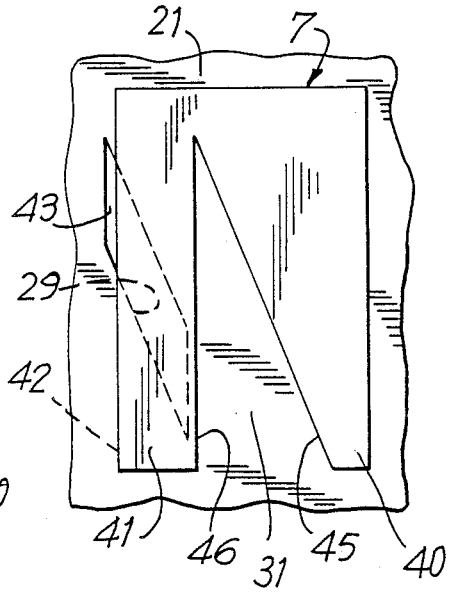
FIG. 5d

DEVICE FOR CONTROLLING AT LEAST ONE THROTTLE CROSS-SECTION AT A CONTROL OPENING

BACKGROUND OF THE INVENTION

The invention relates to a device for controlling a throttle cross-section of at least one control orifice in a bypass line of idling control of internal combustion engine, comprising a positioning motor for moving a throttle member and a return spring element for moving the throttle member to an initial position thereof. A device of this kind is already known (German Offenlegungsschrift No. 3,234,468). It has the disadvantage that in the event of the spring element being inoperative, for example because the spring element has broken, and the positioning motor being excited, or in the event of a malfunction in the electronic control device, the control orifice is opened completely by the throttle member, and the operation of the internal combustion engine is influenced in an undesirable manner or even endangered by running at too high a speed.

SUMMARY OF THE INVENTION

The object of the invention is a device that, in the event of an excitation of the positioning motor which leads to a position of the throttle member which is impermissible for the operating condition of the internal combustion engine, does not deliver a stream of operating medium which influences the operation of the internal combustion engine in an undesirable manner or put it at risk from running at too high a speed. The object of the invention is achieved by moving throttle member into a position in which, when the positioning motor is excited, the safety cross-section of the bypass line is such that smaller quantity of the operating medium flows therethrough per unit of time. A position of the throttle member which is impermissible for the operating condition of the internal combustion engine can occur in the event of the spring element being inoperative, for example a rupture of the spring element against which the positioning motor operates, and/or a malfunction in an electronic component of the control device used for controlling the positioning motor. The establishment of a safety cross-section of the bypass line has the effect of limiting the quantity of operating medium flowing per unit time so that the internal combustion engine can be operated without putting it at risk.

It is particularly advantageous to form the safety cross-section by a partial region of the control orifice and to open it by a control edge of the throttle member.

It is furthermore advantageous to move the throttle member beyond the position in which it closes the control orifice into the position which opens the safety cross-section.

The present invention as to its construction so to its mode of operation, together with additional objects and advantages thereof, will be best understood from the following detailed description of the preferred embodiments when read with reference to the accompanying drawings.

BRIEF DESCRIPTION OF THE DRAWINGS

FIGS. 5*a* to *d* show a simplified representation of the positions of a throttle member having a triangular throttle orifice with respect to a parallelogram-shaped control orifice in a second embodiment of a device according to the invention.

DESCRIPTION OF THE PREFERRED EMBODIMENTS

Figure 1:
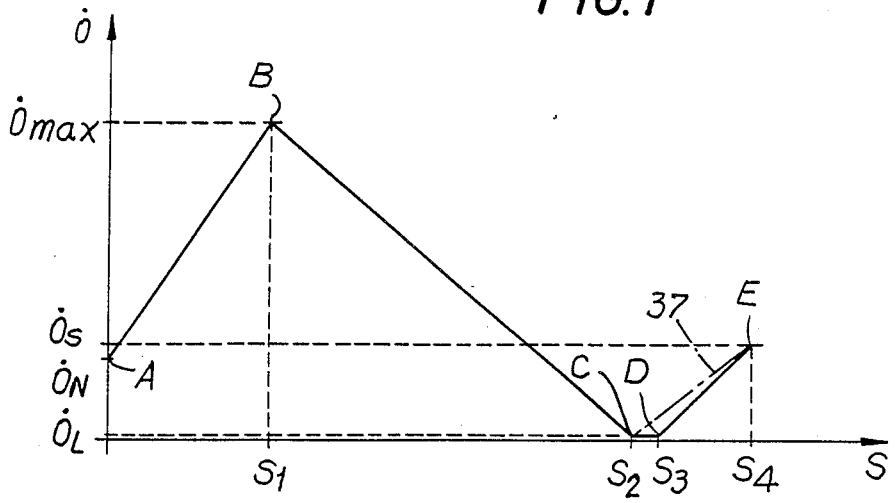
FIG. 1 shows the relationship between a diagram which shows the quantity of operating medium flowing through, per unit time Q, and the adjustment path s of the throttle member.

In FIG. 1, the quantity Q flowing per unit time, of an operating medium to be controlled, for example of the quantity of idling air for the internal combustion engine, which air is to be controlled during the idling of an internal combustion engine, is represented, in a diagram, which shows the quantity of air flowing through in accordance with the adjustment path s of a throttle member of a device as described in the following text with reference to various embodiments. In the device represented in FIGS. 2 and 3, combustion air flows through an intake pipe 2 past a throttle valve 3 in the direction of arrow 1 to an internal combustion engine (not shown). The intake pipe 2 is connected to a bypass line 5 which leads around the throttle valve 3 and the passage cross-section of which can be altered by a throttle member 7 of the device 6. The device 6 is controlled by an electronic control device 8 which receives at 10 the supply voltage from the vehicle battery, at 11 the signal for the speed of the internal combustion engine, which signal is being taken from the distributor of the internal combustion engine, at 12 the signal for the engine temperature, and at 13 a voltage which identifies the position of the throttle valve 3 and is supplied, for example, by a potentiometer connected to the throttle valve 3. If required, additional operating variables of the internal combustion engine can be fed into the electronic control device 8.

In the present embodiment, an electric motor 15 (not illustrated in greater detail) which can be controlled by the electronic control device 8 via a plug connector 16, as a function of operating variables of the internal combustion engine, is used as positioning motor of the device 6. In the excited condition, the electric motor 15 rotates a hollow shaft 17 which, via rolling bearings 18, is rotatably mounted about a spindle 19 which is pressed into a housing base 21 of a cupshaped housing 22 of the device 6 and is fixed therein. The throttle member 7, which is of a tube segment-shaped design and extends into a pivoting space 24 which is formed in the housing base 21 and divides the bypass line 5, is connected to the hollow shaft 17 for joint rotation therewith. An inflow connection 26 to the intake pipe 2 upstream of the throttle valve communicates with the pivoting space 24, on one hand, and an outflow connection 27 to the intake pipe 2 downstream of the throttle valve 3 communicates with the pivoting space 24, on the other hand. The periphery of the tube segment-shaped throttle member 7 extends as close as possible to the wall defining the pivoting space 24. At least one control orifice 29 which can be opened to a greater or lesser extent by the throttle member 7 is cut in the wall 28 defining the pivoting space 24 which faces the inflow connection 26. For this purpose, it is possible, for example, for the tube segment-shaped throttle member 7 to have a throttle orifice 31 which communicates with it and, in the case of a rotary movement of the throttle member 7, is brought to a greater or lesser extent into overlap with the control orifice 29 and thereby opens the control orifice 29 to a greater or lesser extent, with the formation of a throttle cross-section. The rotation of the throttle member 7 by the electric motor 15 takes place against the force of a spring element which may, for example, be designed as a spiral spring 32 and is connected by its inner end to the hollow shaft 17 and by its outer end to the housing 22. In the non-excited condition of the electric motor 15, the spiral spring 32 rotates the hollow shaft 17 by a stop portion 33 against a stop screw 34 screwed into the housing base 21. With the stop portion 33 resting against the stop screw 34, the throttle member 7 is held by the spiral spring 32 in a starting position in which the control orifice 29 is not completely closed by the throttle member 7 but in which the throttle orifice 31 is in partial overlap with the control orifice 29, with the result that in this position, an emergency-running cross-section 36 remains open, via which air or a mixture can flow through the bypass line 5 into the intake pipe 2 from upstream of the throttle valve to downstream of the throttle valve 3. In the event of the failure of the supply of current to the device 6, the quantity of operating medium flowing through the emergency-running cross-section 36 per unit time is sufficient to provide a favorable fuel/air mixture for the continued running of the internal combustion engine or to allow a predetermined favorable quantity to flow to the engine on starting the internal combustion engine. In the diagram according to FIG. 1, the quantity of operating medium flowing through the emergency-running cross-section per unit time is designated by $Q_N$, given the presence of which the throttle member 7 is in its starting position zero.

The intention is now, according to the invention, beginning from the starting position zero of the throttle member. The starting position represents the emergency-running cross-section 36, so that, when the electric motor is excited, the throttle member 7 should execute a movement in a direction of movement, which remains the same, during which it first of all opens the control orifice 29 completely by the throttle orifice 31 and should only then be moved further by the electronic control device in accordance with the control current depending on the operating variables of the internal combustion engine so that it closes the control orifice 29 again to a greater or lesser extent, and so that the overlap between the throttle orifice 31 and the control orifice 29 is reduced. This produces a characteristic curve for the device 6 as characterized in FIG. 1 by the curve shape illustrated. In the throttle member starting position representing the control path zero, the curve illustrated in FIG. 1 begins at point A with a quantity of emergency-running operating medium per unit time $Q_N$ characterizing through (sic) the emergency-running cross-section 36. If the electric motor 15 is excited by the control device 8, the electric motor 15 moves the throttle member 7 in the direction of a further enlargement of the throttle cross-section formed between the control orifice 29 and the throttle orifice 31, until after the relatively short adjustment path $s_1$, the control orifice 29 and the throttle orifice 31 overlap completely and, at point B of the curve, the maximum quantity of operating medium per unit time $Q_{max}$ can flow via the bypass line 5. Only after the position of throttle member which is identified by point B and in which the maximum quantity $Q_{max}$ of operating medium can flow via the control orifice 29, is it possible, by virtue of movement of the throttle member 7 continued in the same direction of movement a previously, for a reduction of the overlap between the control orifice 29 and the throttle orifice 31, to take place in accordance with the control signals of the control device 8 so that, if required, the throttle cross-section formed between these two orifices can be reduced, or is closed so that there is no longer any overlap between the control orifice 29 and the throttle orifice 31 and only a leakage quantity attributable to leaks flows via the bypass line 5. The movement of the throttle member 7 from position $s_1$, in which the control orifice 29 is completely opened by the throttle orifice 31, into position $s_2$, in which the control orifice 29 is completely closed by the throttle member 7 and only a leakage quantity per unit time $Q_L$ can still flow via the bypass line 5, and which is identified by point C, is characterized by the curve shape between points B and C. In a further embodiment of the device, provision can be made in the event of a failure, for example breakage of the spiral spring 32 or a malfunction of an electronic component of the control device 8, for the throttle member 7 to be moved by the excited electric motor 15 into a position $s_4$ in which the throttle member 7 opens a safety cross-section at the control orifice 29, allowing a quantity of operating medium per unit time $Q_S$ to flow via this safety cross-section and via the bypass line 5, which quantity guarantees safe operation of the internal combustion engine which does not endanger the internal combustion engine and which quantity is less than the maximum possible quantity of operating medium flowing per unit time $Q_{max}$ via the control orifice 29.

It is possible for point E in FIG. 1, identifying the safety cross-section, to be reached directly from position $s_2$ of the throttle member 7 at point C, in which only a leakage quantity $Q_L$ still flows in accordance with the chain-dotted line 37 by a movement into position $s_4$ during which, starting from the leakage quantity $Q_L$ at point C, a renewed enlargement of the throttle cross-section at the control orifice 29 takes place up to point E. A further possibility comprises first of all moving the throttle member 7 from position $s_2$ as far as position $s_3$ without the control orifice 29 being opened. The adjustment movement from position $s_2$ to position $s_3$ of the throttle member 7 is identified by the curve shape from point C to point D. In the adjustment range between position $s_2$ and position $s_3$, only the leakage quantity $Q_L$ can flow via the control orifice 29. The further opening of the throttle cross-section up to point E, in which the throttle member 7 occupies position $S_4$ and the safety cross-section at the control orifice 29 is open, via which cross-section the safety quantity of operating medium $Q_S$ can flow, takes place in accordance with the solid line, starting from point D, that is to say position $s_3$ of the throttle member 7. In the case of an adjustment of the throttle member 7 in the same direction of movement, the characteristic curve which is illustrated in FIG. 1 and extends between points A, B, C, D and E indicates the size of the throttle cross-section formed between the at least one control orifice 29 and the at least one throttle orifice 31, said size being equivalent to the quantity of operating medium flowing via the bypass line 5 per unit time Q. In this arrangement, it is particularly advantageous that, upon excitation of the electric motor 15, the complete opening of the control orifice 29 by the throttle orifice 31 can already be achieved in position $s_1$ after a very short adjustment path, starting from the starting position of the throttle member 7, said starting position representing the emergency-running cross-section 36, in which position the maximum quantity of operating medium $Q_{max}$ can flow via the bypass line 5. Only in the event of a further movement of the throttle member 7 beyond position $s_1$ does the actual regulation of the throttle cross-section up to point C begin, so that each intermediate position of the throttle member 7 from the complete opening of the control orifice 29 at point B and the maximum quantity of operating medium $Q_{max}$ flowing which is possible in this position to virtually complete blocking of the control orifice 29 at point C, in which only a leakage quantity $Q_L$ can flow, is possible as a function of the operating variables of the internal combustion engine. The characteristic curve shape shown ensures that, even in the most unfavourable starting conditions of the internal combustion engine, in which, as a result of low starting temperatures and a requirement for current also for other units of the internal combustion engine, the supply voltage of the motor vehicle battery has fallen, this low supply voltage is still sufficient to move the throttle member 7 into a position $s_1$ in which a maximum quantity of operating medium $Q_{max}$ usually required for the reliable start and continued running of the internal combustion engine, can flow via the bypass line 5.

Figure 2:
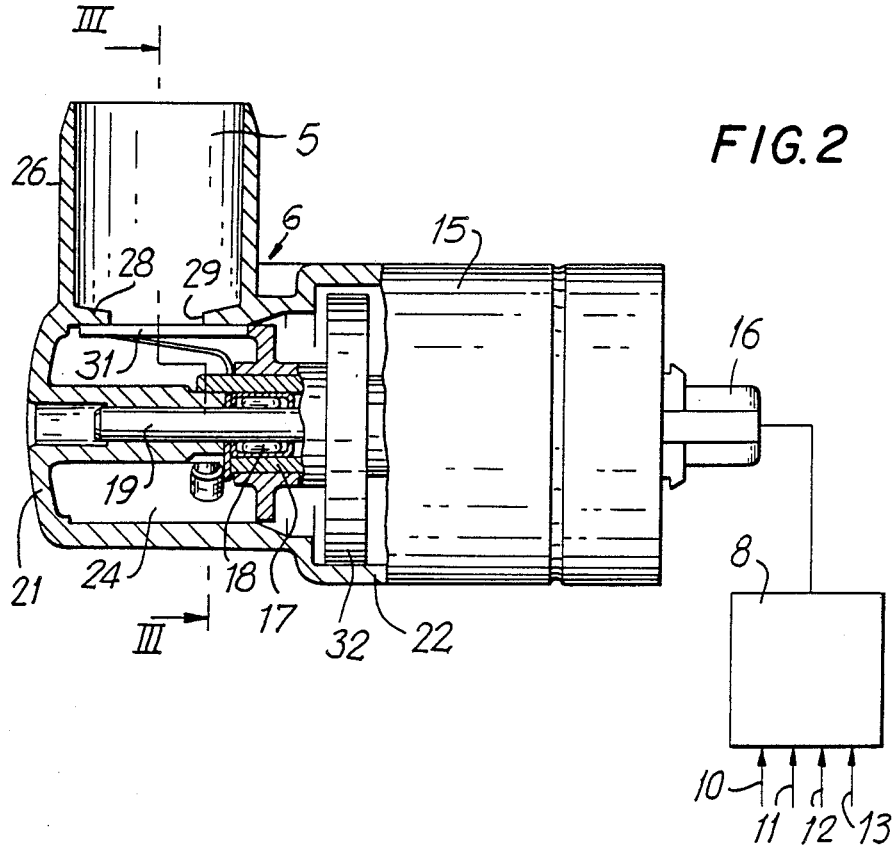
FIG. 2 shows a cross-sectional view along the line II—II in FIG. 3 of a device according to the present invention for controlling at least one throttle cross-section.
Figure 3:
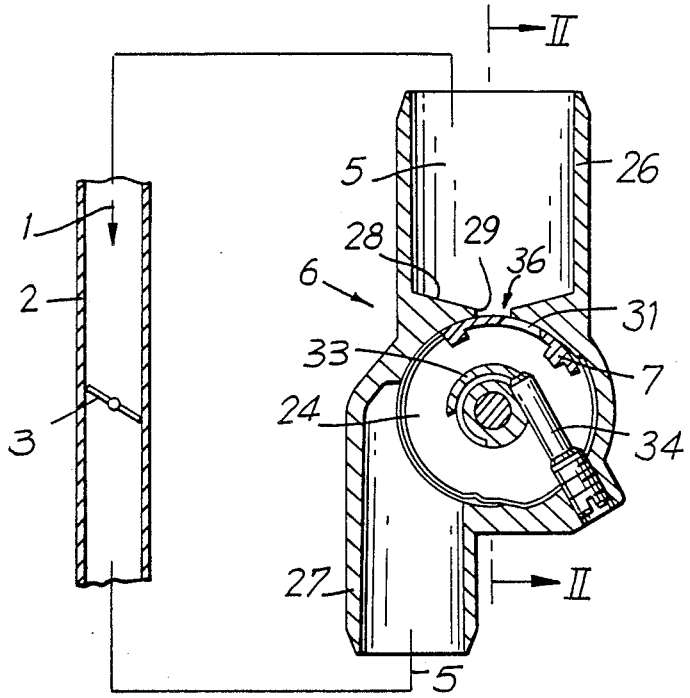
FIG. 3 shows a cross-sectional review along the line III—III in FIG. 2, FIGS. 4*a* to *d* show a simplified representation of various positions of a throttle member having a throttle orifice with respect to a control orifice in a first embodiment of a device according to the invention.
Figure 4A:
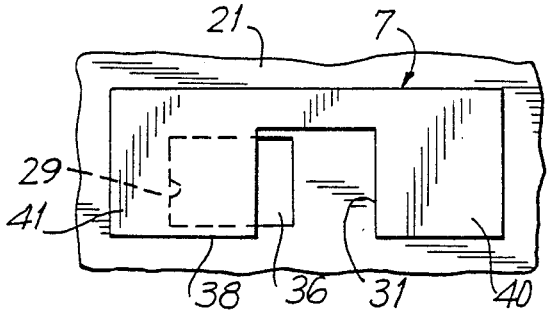
Figure 4B:
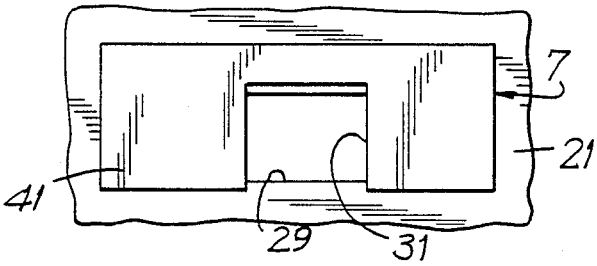
Figure 4C:
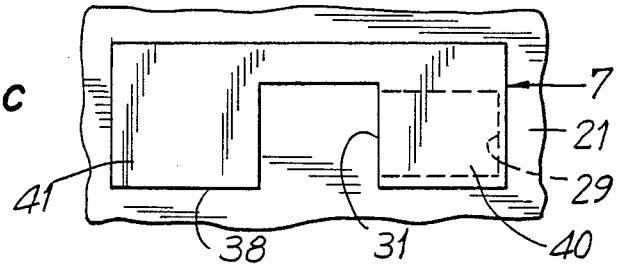
Figure 4D:
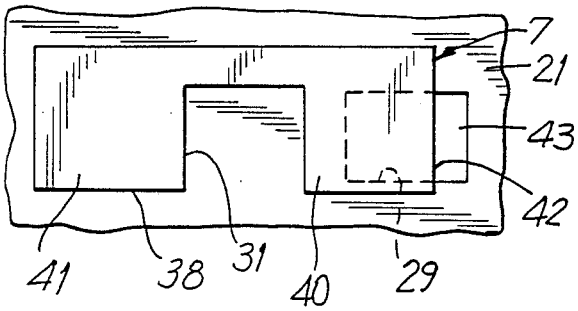
Figure 7A:
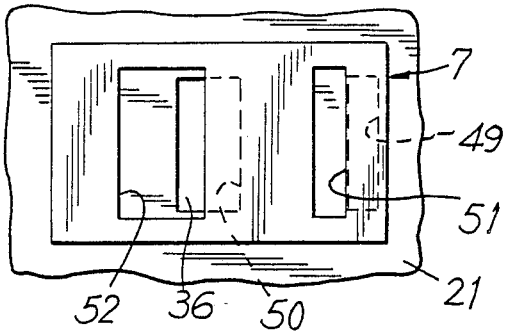
Figure 7B:
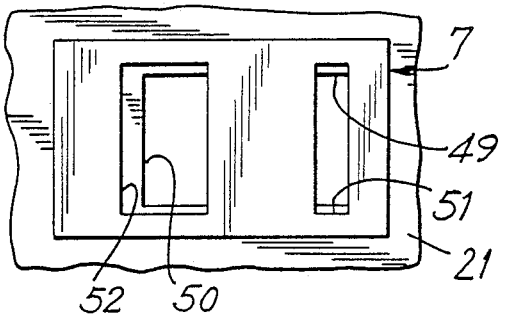
Figure 7C:
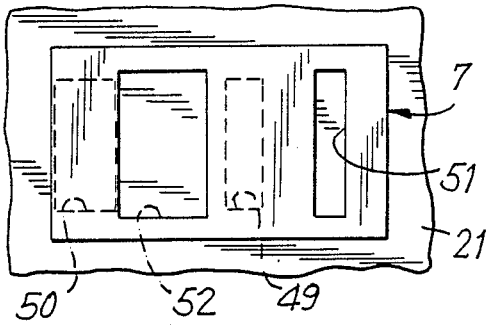
Figure 7D:
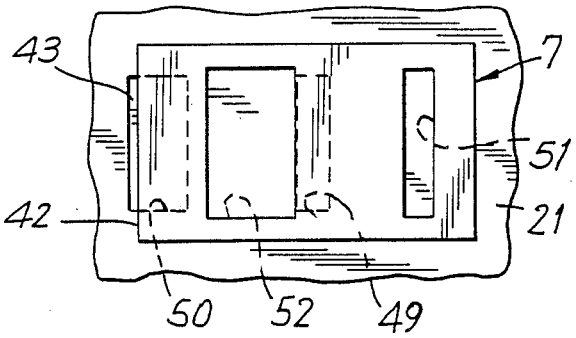

An embodiment of a throttle member 7 and of a control orifice 29 of a device 6 according to FIGS. 2 and 3, by which embodiment a characteristic curve according to the curve shape from A to E according to FIG. 1 can be achieved, is illustrated in FIGS. 4*a* to *d*. The same reference numerals have been chosen for parts which are the same and have the same effect. The embodiment according to FIGS. 4*a* to *d* can be used not only with an embodiment of the throttle member as a rotary slide but also with other embodiments of the throttle member 7, for example in the form of a planar flat slide. In FIG. 4, the throttle member 7 is designed, for example, as a planar flat slide and has a rectangular throttle orifice 31, which may also be quadratic, circular or of some other spherical shape. The throttle orifice 31 is open at the edge 38 of the throttle member 7, but can also be closed. In the direction of movement, the throttle orifice 31 is bounded by a right-hand wing 40 and on the other side by a left-hand wing 41. In FIG. 4*a*, the throttle member 7 occupies its starting position which corresponds to point A of the curve in FIG. 1 and in which the control orifice 29 and the throttle orifice 31 overlap only partially, with the result that the emergency-running cross-section 36 at the control orifice 29 remains open while the left-hand wing 41 partially blocks the control orifice 29. In this embodiment, the control orifice 29 has a rectangular form but may likewise be quadratic, circular or of some other spherical shape. When the electric motor 15 is excited, the throttle member 7 is moved to the left with respect to the control orifice 29, in accordance with FIG. 4*b*, and in the process comes into a position $s_1$ in accordance with FIG. 1 in which the control orifice 29 and the throttle orifice 31 overlap completely and the control orifice 29 is completely open, allowing the maximum quantity of operating medium $Q_{max}$ to flow. The actual regulation of the throttle cross-section according to the curve shape from B to C in FIG. 1 begins, starting from the position of the throttle member 7 illustrated in FIG. 4*b*, along which curve shape the control orifice 29 and the throttle orifice 31 overlap to a greater or lesser extent or, respectively, the right-hand wing 40 closes the control orifice 29 to a greater or lesser extent. The position illustrated in FIG. 4*c* corresponds to position $s_2$ in FIG. 1, in which the control orifice 29 is completely closed by the right-hand wing 40 and only a leakage quantity $Q_L$ can still flow. If the spiral spring 32 fails and the electric motor 15 is in the excited condition, the throttle member 7 can now be moved further to the left in accordance with FIG. 4*d* in order, in position $s_4$ corresponding to point E in FIG. 1, to open the control orifice 29 again somewhat by a control edge 42, formed on the right-hand wing 40, to form a safety cross-section 43.

A further embodiment of the device 6 according to FIGS. 2 and 3 to produce a characteristic curve in accordance with FIG. 1, is shown in FIGS. 5*a* to *d*, in which the reference numerals used already are employed for parts which are the same and have the same effect. In the embodiment according to FIGS. 5*a* to *d*, the control orifice 29 of the device 6 has the shape of a parallelogram and the throttle orifice 31 formed in the throttle member 7 has the shape of a triangle which, for example, as illustrated, is open towards one edge of the throttle member but may also be closed. The throttle member 7 may once again likewise be planar, arcuate or of some other shape. The right-hand wing 40 is bounded by a left-hand flank 45 of the triangular throttle orifice 31 and the left-hand wing 41 is bounded by a right-hand flank 46 of the throttle orifice 31 and the left-hand flank 45 and the right-hand flank 46 enclose between them an acute angle which corresponds to the acute angle of the parallelogram-shaped control orifice 29 between two adjacent sides of the control orifice. The throttle member 7 and the control orifice 29 are arranged in such a manner with respect to one another that the left-hand flank 45 and the right-hand flank 46 in each case run parallel to two of the sides of the control orifice 29 and that, when the throttle member 7 is moved into a position in which the control orifice 29 is completely open, the flanks 45, 46 of the throttle orifice 31, which flanks enclose the angle, coincide with two adjacent sides, which likewise enclose an angle. In the position of the throttle member 7 illustrated in FIG. 5*a*, the starting position is shown in which the control orifice 29 and the throttle orifice 31 partially overlap to form the emergency-running cross-section 36, that is to say the right-hand wing 40 covers the control orifice 29 only partially with the left-hand flank 45. FIG. 5*b* illustrates the position $s_1$ of the throttle member 7 in accordance with FIG. 1, in which the throttle orifice 31 opens the control orifice 29 completely to allow through a maximum quantity of operating medium $Q_{max}$ and the flanks 45, 46 coincide with two adjacent sides of the parallelogram-shaped control orifice 29. FIG. $5_c$ shows the position $s_2$ according to FIG. 1 of the throttle member 7, in which the lefthand wing 41 blocks the control orifice 29 completely and only a leakage quantity $Q_L$ can flow. To control a safety cross-section 43 at the control orifice 29, the throttle member 7 can be moved further towards the right into a position $s_4$ in accordance with FIG. 1, in which a portion of the control orifice 29 is opened again by the control edge 42 of the left-hand wing 41.

Figure 6:
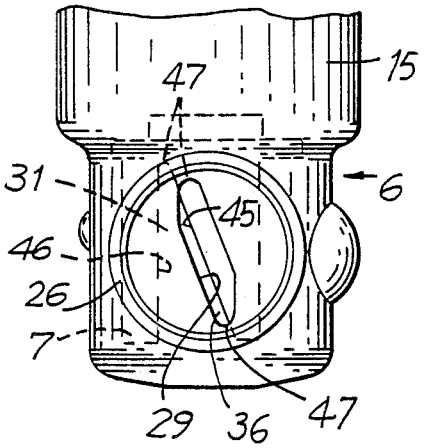
FIG. 6 shows a partial plan view of a device in accordance with FIGS. 2 and 3 and having a control orifice and a throttle orifice in accordance with FIGS. 5*a* to *d*, and FIGS. 7*a* to *d* show a simplified representation of the positions of a throttle member designed with two throttle orifices with respect to two control orifices in a third embodiment of a device according to the invention.

FIG. 6 shows a plan view of a device 6 according to FIGS. 2 and 3, with a view into the inflow connection 26, through which the control orifice 29, which can be controlled by a throttle member 7 indicated by broken lines, can be seen. The control orifice 29 is, in accordance with the embodiment according to FIGS. 5*a* to *d* of a parallelogram-shaped design, and the throttle orifice 31 in the throttle member 7 is of a triangular design. In the embodiment according to FIG. 6, the flanks 45, 46 of the throttle orifice 31 and the sides of the control orifice 29 merge into one another with a radius 47, thereby making it possible to produce these orifices more easily and more accurately.

In the additional embodiment illustrated in FIG. 7, parts which are the same and have the same effect are identified by the same reference numerals as hitherto. In the embodiment according to FIGS. 7*a* to *d*, in contrast to the embodiment according to FIGS. 4*a* to *d*, two control orifices 49, 50 and two throttle orifices 51, 52 in the throttle member 7 are provided. These orifices have a rectangular cross-section but may have another shape in the manner described above. The control orifices 49, 50 and the throttle orifices 51, 52 are in each case arranged at a distance from one another. The control orifices 49, 50 are expediently of different widths, and the same applies to the throttle orifices 51, 52. In the embodiment illustrated in FIGS. 7*a* to *d*, the control orifice 49 arranged on the right is narrower than the control orifice 50 arranged on the left, and the throttle orifice 51 a ranged on the right is narrower than the throttle orifice 52 arranged on the left. In the manner illustrated, the distance between the orifices can be selected such that, in the starting position of the throttle member 7, that is to say when the electric motor 15 is not excited, the right-hand control orifice 49 is closed by the throttle member 7, and the left-hand control orifice 50 is in partial overlap with the left-hand throttle orifice 52 so as to form the emergency-running cross-section 36, as shown in FIG. 7*a*. In the position $s_1$ of the throttle member 7 according to FIG. 1, which position is illustrated in FIG. 7*b*, the two control orifices 49, 50 are completely 'opened by the throttle orifices 51, 52, allowing the maximum quantity of operating medium $Q_{max}$ to flow via the bypass line 5. If the throttle member 7, which is likewise designed as a flat slide, rotary slide or is of some other shape, is moved further, the throttle member 7 comes to occupy a position $s_2$ which is illustrated in FIG. 7*c* and in which the control orifices 49, 50 are closed and, in accordance with FIG. 1, only a leakage quantity $Q_L$ still flows. If the spiral spring 32 fails and the electric motor 15 is excited, the throttle member 7 occupies a position $s_4$ according to FIG. 1, as shown in FIG. 7*d*, in which the control edge 42 partially opens the left-hand control orifice 50 to form a safety cross-section 43. In the embodiment illustrated, the right-hand control orifice 49 is not made use of for the formation of the safety cross-section, but the embodiment could also be chosen such that a part of the control orifice 50 and a part of the control orifice 49 could be opened to form the safety cross-section in a manner not shown.

While the invention has been illustrated and described as embodied in a device for controlling a cross-section of at least one control orifice, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for controlling a throttle cross-section of at least one control orifice in a bypass line extending around a throttle valve of an air intake pipe of an internal combustion engine, for regulating an idle speed of the internal combustion engine, said device comprising a throttle member having an initial position and movable relative to said one control orifice to define the throttle cross-section thereof; spring means for biasing said throttle member to the initial position thereof; and a positioning motor for moving said throttle member from the initial position of said throttle member against a bias force of said spring means; said throttle member, upon failure of said spring means and when said positioning motor is actuated, being movable to a position in which a safety cross-section in the bypass line is established and a quantity of operating medium flowing through said safety cross-section being less than a quantity of operating medium flowing through a complete cross-section of said control orifice whereby idle operation of the internal combustion engine is insured.

2. A device according to claim 1, wherein said safety cross-section is formed by a portion of said control orifice.

3. A device according to claim 1, wherein said throttle member has a control edge which defines said safety cross-section.

4. A device according to claim 1, wherein said throttle member is movable beyond a position in which it completely closes said control orifice to the position in which said safety cross-section is established.

5. A device according to claim 1, wherein said positioning motor is an electric motor.

* * * * *